US005971777A

United States Patent [19]

Garside

[11] Patent Number: 5,971,777

[45] Date of Patent: Oct. 26, 1999

[54] BREAKAWAY PHYSICAL/ELECTRICAL MEDIA JACK

[75] Inventor: R. Troy Garside, West Bountiful, Utah

[73] Assignee: 3Com Corporation, Santa Clara, Calif.

[21] Appl. No.: 08/976,199

[22] Filed: Nov. 21, 1997

[51] Int. Cl.[6] ..... H01R 13/44

[52] U.S. Cl. ..... 439/131; 439/676

[58] Field of Search ..... 439/131, 676, 439/344, 946.2

[56] References Cited

U.S. PATENT DOCUMENTS

| | | | |
|---|---|---|---|
| 5,035,641 | 7/1991 | Van-Santbrink et al. | 439/329 |
| 5,044,981 | 9/1991 | Suffi et al. | 439/533 |
| 5,118,311 | 6/1992 | Margini | 439/676 |
| 5,183,404 | 2/1993 | Aldous et al. | 439/676 |
| 5,244,412 | 9/1993 | Hatch et al. | 439/567 |
| 5,310,360 | 5/1994 | Peterson | 439/571 |
| 5,338,210 | 8/1994 | Beckham et al. | 439/131 |
| 5,364,294 | 11/1994 | Hatch et al. | 439/676 |
| 5,478,252 | 12/1995 | Lecomte et al. | 439/180 |
| 5,478,261 | 12/1995 | Bogese, II | 439/676 |
| 5,503,572 | 4/1996 | White et al. | 439/676 |
| 5,538,442 | 7/1996 | Okada | 439/676 |
| 5,547,401 | 8/1996 | Aldous et al. | 439/676 |
| 5,562,504 | 10/1996 | Moshayedi | 439/676 |

*Primary Examiner*—Khiem Nguyen
*Assistant Examiner*—T C Patel
*Attorney, Agent, or Firm*—Workman, Nydegger & Seeley

[57] ABSTRACT

A physical/electrical media jack is configured for electrically coupling with a physical/electrical media plug. The jack includes a housing having an interior chamber communicating with the exterior through an opening. Positioned on opposing sides of the opening are a pair of blocking ridges each having an inside sloping edge. In one embodiment, dovetailed splines are positioned on the exterior surface of the housing for receipt in complementary keyways formed in the border frame of a PC Card or the casing of an electrical apparatus. The jack further includes a retractable access portion having an aperture formed therein for receiving a media plug. The second end of the retractable access portion is slidably received within the opening in the housing. Outwardly projecting from opposing sides of the retractable access portion at the second end are a pair of retention lips. The retention lips bias against the blocking ridges to prevent unwanted removal of the retractable access portion from the housing. The retention lips and blocking ridges, however, are configured to enable removal of the retractable access portion through the opening without mechanical failure of the jack when sufficient outward force is applied to the retractable access portion.

27 Claims, 5 Drawing Sheets

BREAKAWAY PHYSICAL/ELECTRICAL MEDIA JACK

BACKGROUND OF THE INVENTION

1. The Field of the Invention

The present invention relates to electrical receptacles, and more specifically, breakaway physical/electrical media jacks for coupling with physical/electrical media plugs.

2. Present State of the Art

Physical/electrical media couplers, such as RJ-type couplers, provide an easy and quick method for coupling a data or telephone line to hardware such as a telephone, modem, or computer. Due to the simplicity of the connection and the corresponding standardized structure, RJ-type couplers are used extensively in the telecommunication and computer industries. RJ-type couplers include a plug or contact block and a receptacle or socket commonly called a jack. The plug is attached to the end of an electrical cable or wire. During use, the RJ plug is selectively received within the jack to facilitate physical and electrical connection.

An RJ plug comprises a small block which houses a plurality of distinct metal contacts. A plurality of thin slots extend from the end of the block to each of the contacts. Mounted on the outside of the block is retention arm.

In complement, the RJ jack comprises a socket having a plurality of flexible contact wires which are oriented to be received within corresponding slots of the RJ plug when the RJ plug is slid into the socket. The wires within the socket press against corresponding contacts on the RJ plug to complete electrical connection between the RJ plug and the RJ jack. The interior surface of the socket also defines a catch that receives the retention arm on the RJ plug so as to mechanically secure the RJ plug within the socket. To remove the RJ plug, the retention arm is manually flexed to release the catch, thereby enabling manual removal of the RJ plug from the socket.

RJ type jacks are commonly positioned on PC Cards. PC Cards are small, thin cardlike structures that house a circuit board. During use, the PC Card is selectively inserted into a small aperture constructed in a personal computer or other electronic equipment. The circuit board of the PC Card can be constructed to perform a variety of different functions. Most commonly, PC Cards are used for either storing memory or for facilitating communication links over standard or wireless systems.

A conventional PC Card comprises a circuit board having an input/output (I/O) connector attached at one end for coupling with the hardware. Mounted around the remaining perimeter of the circuit board is a plastic frame. A metal plate is mounted to the plastic frame on each side of the circuit board so as to enclose and protect the circuit board. The RJ jack attached to the PC Card typically comprises a thin plate having a socket formed therein. The plate is slid into the PC Card through an opening formed in the plastic frame. The plate can be either retracted into the PC Card, when not in use, or advanced to expose the socket. The RJ jack is electrically coupled to the circuit board by flexible wires.

Although RJ couplers are used extensively, they have several shortcomings. For example, it is a relatively common occurrence that the plug wire is accidentally pulled or tripped over. If sufficient force is applied, the assembly can fail. This is typically the result of structural failure of the plug or failure of the structure surrounding the socket. In the case of the PC Card, the plate is usually pulled out of the card, severing the flexible wire connection between the RJ jack and the circuit board. Pulling the plate out of the PC Card can also structurally damage the plate and/or the PC Card since the two structures are not designed to be separated. The above failures, particularly to the PC Card, are not typically user repairable. Accordingly, new components must be purchased and/or the parts returned to the factory for repair.

An additional problem with conventional RJ jacks is that they are limited to coupling with a single type of plug. RJ plugs come in different sizes and numbers of contact wires to facilitate different purposes. To use different plug configurations, the hardware must either be formed with a variety of different sockets or a variety of different PC Card must be purchased having different jacks.

There are additional problems directly related to sliding jacks used in PC Cards. For example, where the RJ jack passes through the frame of the PC Card, an inherent weakness in the card is produced. This is because the edges of the frame on opposing sides of the RJ jack are not connected. Furthermore, the top and bottom covers positioned on opposing sides of the jack are also freely exposed. Numerous problems have also been encountered as a result of having to use a flexible wire which attaches between the circuit board of the PC Card and the jack. For example, flexible wire requires manual positioning and attachment and must be properly positioned to prevent wear or obstruction with the sliding plate. In addition, since the sliding plate is continually in electrical contact with the circuit board through the flexible wire, the card must be uniquely designed so as to prevent the plate from shorting on the PC Card when the plate is retracted therein.

OBJECTS AND BRIEF SUMMARY OF THE INVENTION

Accordingly, it is an object of the present invention to provide improved physical/electrical media jacks for coupling with physical/electrical media plugs.

Another object of the present invention is to provide improved physical/electrical mediajacks wherein a portion of each jack can be selectively removed to prevent structural failure of the jack when an outward force is applied thereto.

Yet another object of the present invention is to provide improved physical/electrical media jacks as above wherein the user can easily replace the removed portion of the jack.

Still another object of the present invention is to provide improved physical/electrical media jacks wherein each jack can be selectively modified to couple with alternative physical/electrical media plugs.

Another object of the present invention is to provide improved retractable physical/electrical media jacks which do not require flexible wire connections.

Finally, another object of the present invention is to provide improved physical/electrical media jacks wherein the contact wires of the jack are not electrically charged when the jack is retracted within a PC Card or other structure.

To achieve the foregoing objects, and in accordance with the invention as embodied and broadly described herein, a physical/electrical media jack is provided. The physical/electrical media jack includes a housing having an interior chamber that communicates with the exterior through an opening. Inwardly projecting from the housing on opposing sides of the opening are a pair of blocking ridges each having an inside sloping face.

In one embodiment, the housing is positioned within a PC Card. In this embodiment, a plurality of dove-tailed splines are formed on the exterior surface of the housing. The splines are configured to be received within complementary keyways formed on the border frame of the PC Card. This mechanical engagement between the housing and the PC Card increases the strength of the overall PC Card. In alternative embodiments, the housing can be mounted to the casing or other structural elements of electrical apparatus such as computers, telephones, or modems.

The physical/electrical media jack further includes a retractable access portion having a second end slidable received within the opening of the housing. Projecting from opposing sides of the retractable access portion are a pair of retention lips. The retention lips are configured to bias against the blocking ridges to prevent unwanted removal of the retractable access portion from within the housing. As a result of the sloped surfaces on the blocking ridges, however, when a sufficient outward force is applied to the retractable access portion, the retention lips wedge against the blocking ridges so as to expand the opening in the housing. When the opening expands, the second end of the retractable access portion can pass therethrough, thereby facilitating removal of the retractable access portion without mechanical failure to the jack. The retractable access portion can subsequently be inserted back into the housing by simply pressing the retractable access portion through the opening.

Extending through the retractable access portion is an aperture. The aperture is configured to receive a physical/electrical media plug in both electrical and mechanical engagement. Contact wires mounted to the retractable access portion project into the socket to electrically engage the plug when received therein.

The automatic removal of the retractable access portion prevents structural damage to the physical/electrical media jack when an accidental outward force is applied thereto. Furthermore, by being able to selectively remove the retractable access portion, alternative retractable access portions configured to couple with alternative physical/electrical media plugs can be selectively inserted into the housing.

Transition wires are also mounted to the housing to enable electrical coupling between the retractable access portion and the housing. Each transition wire includes a first portion that is exposed within the interior chamber of the housing adjacent to the opening; a second portion that projects out the back side of the housing for coupling with a circuit board or other electrical apparatus; and a middle portion which is enclosed within the housing. The second portion of each transition wire is directly connected to a circuit board to other desired electrical structure. Since the housing does not independently move, the second portion of the transition wire does not have to be flexibly attached to the desired structure.

When the retractable access portion projects from the housing in a first position, each contact wire biases against the first end of a corresponding transition wire, thereby effecting electrical communication between the housing and the retractable access portion. Once the plug is removed from the aperture, the retractable access portion can be advanced within the housing to a retracted second position. In this position, each contact wire is insulated from contact with the transition wire. As a result, the potential for creating a short through the physical/electrical media jack is minimized.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
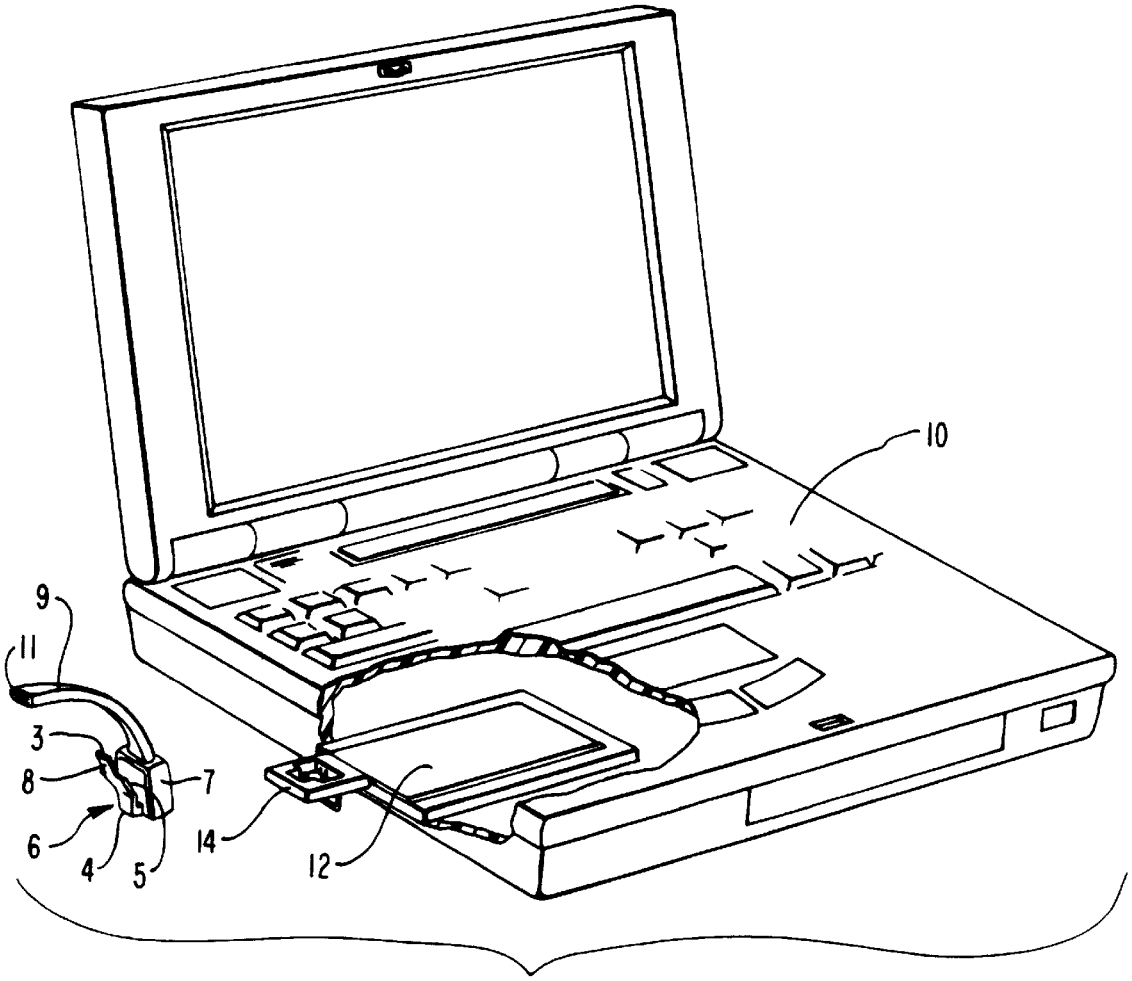
FIG. 1 is a perspective view of a computer having a PC Card with an inventive physical/electrical media jack attached thereto.

Depicted in FIG. 1 is a computer 10 housing a PC Card 12. The term "PC Card," as used in the specification and appended claims, is broadly intended to include the various types of cards falling within the Personal Computer Memory Card International Association (PCMCIA) parameters and communication cards outside of that standard. Secured to PC Card 12 is one embodiment of an inventive physical/electrical media jack 14 incorporating features of the present invention. Jack 14 is configured to electronically couple with a physical/electrical media plug. The term "physical/electrical media plug," as used in the specification and appended claims, is broadly intended to include media plugs such as those plugs having physical attributes described in F.C.C. part 68, subpart F. Examples of physical electrical media plugs include the RJ-11, RJ-45, 6-pin miniature model plug, 8-pin miniature modular plug, and other RJ type plugs.

Depicted in FIG. 1 is one embodiment of a physical/electrical media plug 6. Plug 6 includes a contact pin block 7 having a cable 9 received within the end thereof. Cable 9 houses a plurality of insulated wires 11. A biased retention clip 8 is mounted to the side of block 7. Retention clip 8 comprises a broad fixed end 4 attached to pin block 7, a narrow free end 3, and a transition notch 5 positioned therebetween.

Figure 2:
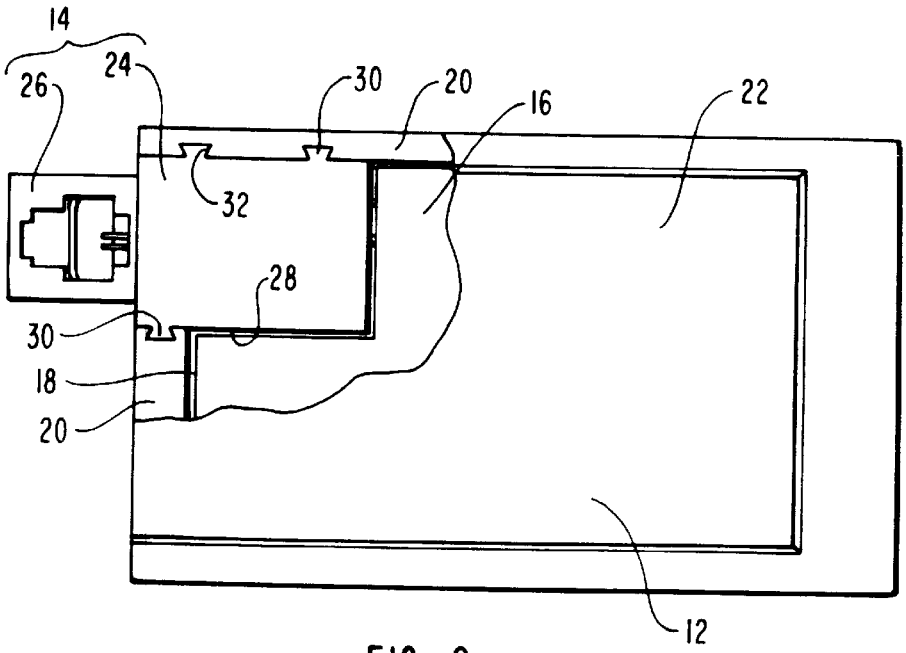
FIG. 2 is a partially cut away top view of the PC Card shown in FIG. 1 disclosing the inventive physical/electrical media jack.

Depicted in FIG. 2, PC Card 12 comprises a circuit board 16 having a perimeter edge 18. Partially bounding perimeter edge 18 is a thin, plastic border frame 20. A metal cover plate 22 is mounted to border frame 20 on each side of circuit board 16, thereby substantially enclosing circuit board 16. Each cover plate 22 is preferably attached to boarder frame 20 by an adhesive. In alternative embodiments, cover plates 22 can be made of alternative materials, such as plastic, and can have border frame 20 integrally molded thereon.

Jack 14 comprises a thin block shaped housing 24 having a retractable access portion 26 slidably attached thereto. In one embodiment of the present invention, means are provided for mechanically and rigidly connecting housing 24 to border frame 20. By way of example and not by limitation, housing 24 has an outside edge 28 with a plurality of dovetailed splines 30 projecting therefrom. Formed on border frame 20 are a plurality of keyways 32. Keyways 32 are configured to complementarily receive a corresponding spline 30 so as to mechanically lock housing 24 to frame 20. In alternative embodiments, splines 30 and keyways 32 can be configured with alternative geometries having interlocking features.

By rigidly attaching frame 20 on opposing sides of housing 24, the strength of PC Card 12 is significantly increased relative to conventional PC Cards. Furthermore, since housing 24 does not move, cover plates 22 can be secured to the opposing sides of housing 24 in the same way that they are secured to boarder frame 20, thereby further increasing the strength of PC Card 12.

Figure 3:
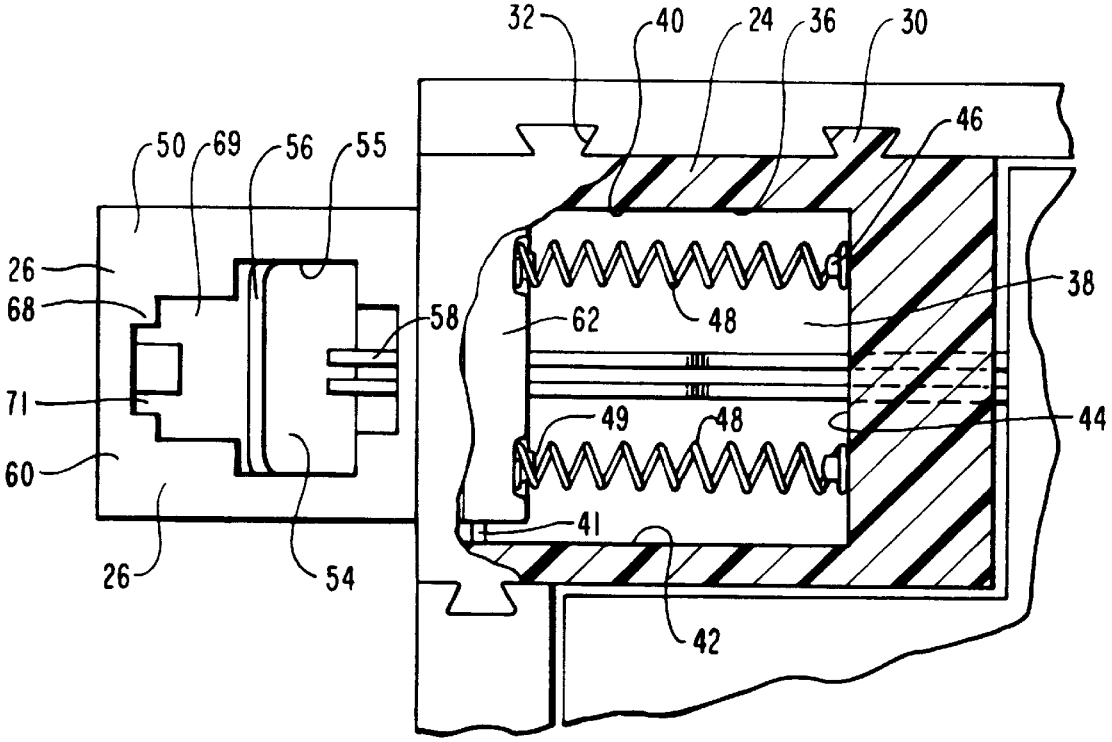
FIG. 3 is an enlarged partially cut away top view of the physical/electrical media jack shown in FIG. 2.

Turning to FIG. 3, housing 24 has an interior surface 36 bounding an internal chamber 38. Interior surface 36 includes opposing sidewalls 40 and 42 and a back wall 44. Projecting into internal chamber 38 from back wall 44 are a pair of spaced apart spring posts 46. Projecting into internal chamber 38 from sidewall 42 is an actuating shaft 41 that will be discussed later. Depicted in FIG. 4, interior surface 36 further includes a top wall 70 and a bottom wall 72. Each wall 70 and 72 extends from backwall 44 to a front end 74. In alternative embodiments, walls 70 and 72 may have openings extending therethrough. In these embodiments, walls 70 and 72 may merely comprise narrow cross supports. Internal chamber 38 communicates with the exterior through an opening 76 extending through front end 74. Opening 76 is partially bounded by a first blocking ridge 78 inwardly projecting from top wall 70 at front end 74 and a second blocking ridge 80 inwardly projecting from bottom wall 72 at front end 74.

Retractable access portion 26 comprises a top surface 50 and an opposing bottom surface 52 each extending between a first end 60 and an opposing second end 62. Recessed within second end 62 of retractable access portion 26 is a pair of spaced apart spring posts 49. Spring posts 49 are aligned with a corresponding spring post 46. In one embodiment of the present invention, means are provided for biasing retractable access portion 26 in a direction external to housing 24. By way of example and not by limitation, a spring 48 extends between each pair of corresponding spring posts 46 and 49. In alternative embodiments, alternative spring configurations, such as rigid wire springs, can be used. The spring could also be positioned on the side of retractable access portion 26 or be replaced by an elastomeric material.

Figure 4:
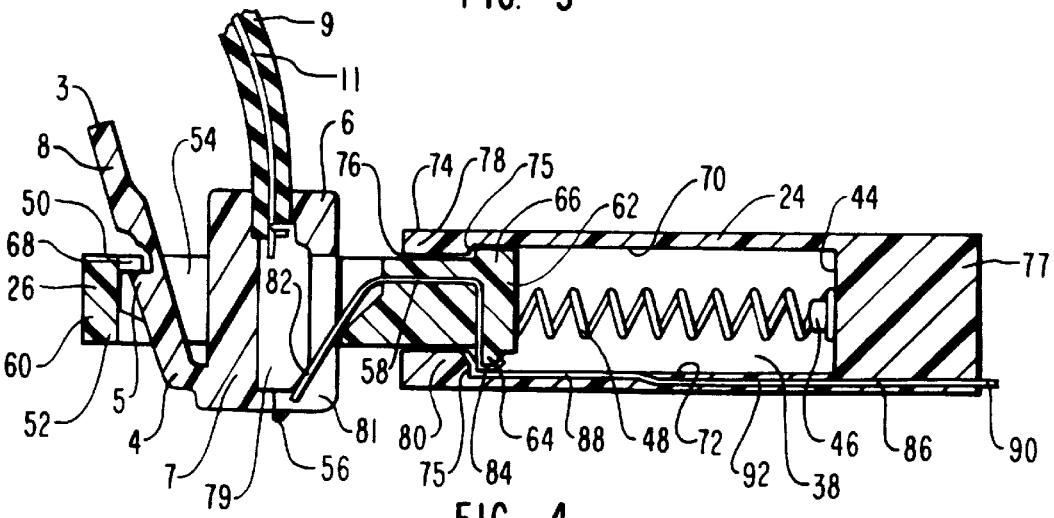
FIG. 4 is a cross-sectional side view of the physical/electrical media jack shown in FIG. 3 having a physical/electrical media plug received therein.

The present invention also includes coupling means for electronically coupling plug 6 with retractable access portion 26. By way of example and not by limitation, depicted in FIGS. 3 and 4, retractable access portion 26 comprises an aperture 54 extending between top surface 50 and bottom surface 52. Aperture 54 has an interior surface 55 configured complementary to the transverse cross section of plug 6, thereby enabling plug 6 to be received within aperture 54 as depicted in FIG. 4.

Plug 6 further comprises a plurality of discrete contact pins 79 disposed within block 7. Each contact pin is electrically coupled to a corresponding wire 11. A plurality of slot 81 extend through the end of block 7 to communicate with a corresponding contact pin 79. Disposed within second end 62 of retractable access portion 26 are a plurality of contact wires 58. Each contact wire 58 has a first end 82 projecting into aperture 54. When plug 6 is received within aperture 54, first end 82 of each contact wire 58 is received within a corresponding slot 81 in plug 6 so as to bias against a contact pin 79, thereby effecting an electrical connection therebetween.

Alternative embodiments of the coupling means are disclosed in U.S. Pat. No. 5,547,401 issued Aug. 20, 1996 in the names of Stephen C. Aldous and Guy N. Dake (hereinafter "the '401 patent") and U.S. patent application Ser. No. 5,338,210 issued Aug. 16, 1994 in the names of D. Scott Beckham, Greg A. Putnam, Lorraine Bolt, Stephen C. Aldous, Guy M. Dake, and James B. Henrie (hereinafter "the '210 patent") which patents are incorporated herein by specific reference.

The present invention also includes means for preventing passage of contact pin block 7 completely through aperture 54 in retractable access portion 26. By way of example and not by limitation, extending across aperture 54 is a rotatable wire support stirrup 56. As depicted in FIGS. 3 and 4, support stirrup 56 stops the passage of plug 6 through aperture 54 when plug 6 is appropriately positioned therein. A variety of alternative embodiments of the means for preventing passage are disclosed in the '410 patent and '210 patent which were previously incorporated herein by specific reference.

Means are also provided for mechanically securing plug 6 within aperture 54 of retractable access portion 26. By way of example and not by limitation, depicted in FIGS. 3 and 4 aperture 54 includes a broad retention clip groove 69, a narrow retention clip groove 71, and a thin retention ridge 68 projecting on each side of narrow retention clip groove 71. As plug 6 is advanced within aperture 54, retention clip 8 flexes to slide against retention ridges 68. Once transition notches 5 pass by retention ridges 68, retention clip 8 resiliently flexes outward so as to mechanically lock transition notches 5 under retention ridges 68 as depicted in FIG. 4. In this configuration, plug 6 is mechanically secured within aperture 54. To remove plug 6 from aperture 54, retention clip 8 is compressed against pin block 7, thereby removing transition notches 5 from under retention ridges 68. A variety of alternative embodiments of the means for mechanically securing plug 6 within aperture 54 of retractable access portion 26 are disclosed in the '410 patent and '210 patent which were previously incorporated herein by specific reference.

Attachment means are also provided for facilitating repeated manual removal and attachment of retractable access portion 26 to housing 24. By way of example and not by limitation, projecting from top surface 50 of retractable access portion 26 at second end 62 is a first retention lip 66. Likewise, projecting from bottom surface 52 of retractable access portion 26 at second end 62 is a second retention lip 64.

Figure 5:
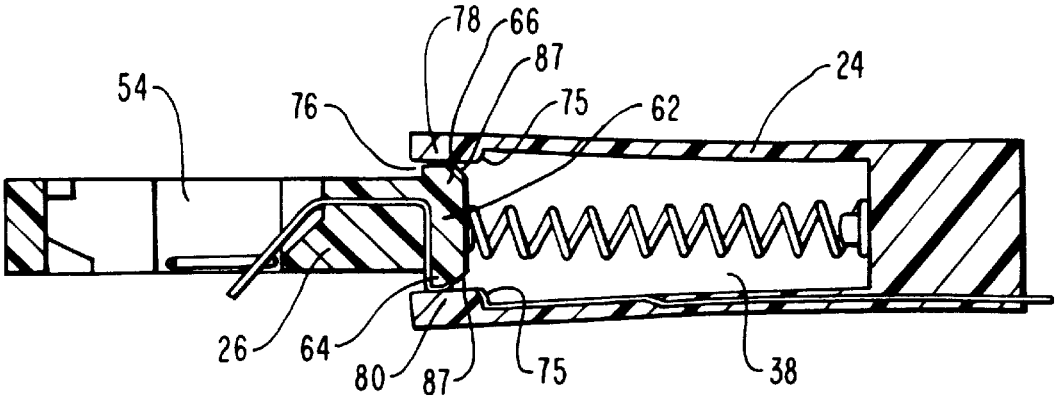
FIG. 5 is a cross-sectional side view of the physical/electrical media jack shown in FIG. 4 with the retractable access portion being removed from the housing thereof.

During operation, second end 62 of retractable access portion 26 is received within internal chamber 38 as depicted in FIG. 4. Springs 48 bias first retention lip 66 against first blocking ridge 78 and bias second retention lip 64 against second blocking ridge 80. The contact between retention lips 64 and 66 and blocking ridges 78 and 80 retains retractable access portions 26 within internal chamber 38 of housing 24. Each blocking ridge 78 and 80, however, has an inside surface 75 that directly contacts a corresponding retention lip 64 or 66 and that slopes toward opening 76. When an outward force is applied to retractable access portion 26, such as when cable 9 attached to plug 6 is pulled or accidentally tripped over, retention lips 64 and 66 act as a wedge against inside surfaces 75 of blocking ridges 78 and 80. This wedging action causes blocking ridges 78 and 80 to spread apart, thereby allowing second end 62 of retractable access portion 26 to pass through opening 76 and out of housing 24 without structural failure of the components as depicted in FIG. 5.

There are of course a variety of alternative configuration that would work equally well for enabling second end 62 of retractable access portion 26 to pass through opening 76 of housing 24. For example, retention lips 64 and 66 could have the sloped faces rather than blocking ridges 78 and 80. Likewise, the retention lips and/or blocking ridges could be rounded. Furthermore, the retention lips and/or blocking ridges could be made out of a soft material that compresses when sufficient force is applied thereto. In other embodiments, it may be preferred that only one retention lip and blocking ridge be used. It is also envisioned that slots may be formed along the side of housing 24 to relieve the stress on housing 24 when second end 62 of retractable access portion 26 pass through opening 76.

Retractable access portion 26 can be manually reinserted into internal chamber 38 by simply sliding second end 62 of retractable access portion 26 back through opening 76 of housing 24. To facilitate inserting retractable access portion 26 into opening 76, retention lips 64 and 66 can be formed with sloped outside comers 87 as depicted in FIG. 5. In this configuration, retention lips 64 and 66 function as a wedge to open opening 76 when advanced therein.

There are a variety of benefits in being able to selectively remove retractable access portion 26 from housing 24. As discussed above, such a configuration prevents structural failure of jack 14 when retractable access portion 26 is accidentally pulled out. Furthermore, retractable access portion 26 can be easily replaced by the user when worn. In addition, by being able to selectively remove retractable access portion 26, a variety of different retractable access portions configured for receiving different physical/electrical media plugs can be selectively received within and coupled to housing 24.

Figure 6:
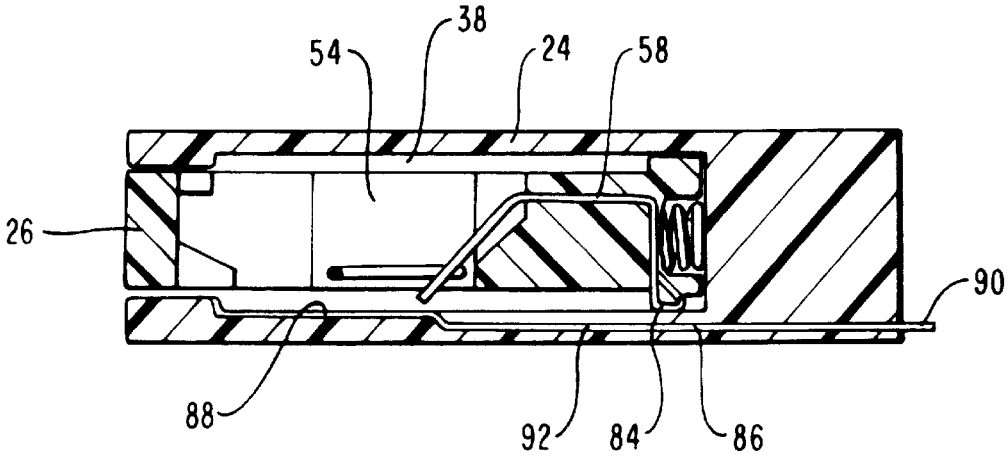
FIG. 6 is a side view of the physical/electrical media jack shown in FIG. 5 with the retractable access portion being received within the housing.

In one embodiment of the present invention, retractable access portion 26 is configured to be retracted within housing 24. For example, depicted in FIG. 4, retractable access portion 26 is in an extending first position. In this first position, aperture 54 is openly exposed to enable coupling with plug 6. When plug 6 is removed, retractable access portion 26 can be selective slid into internal chamber 38 into a retracted second position as depicted in FIG. 6. In this position, retractable access portion 26 is protected when not in use.

The present invention also includes contact means for facilitating electrical connection between retractable access portion 26 and housing 24 when retractable access portion 26 is in the extended first position and for preventing electrical connection between retractable access portion 26 and housing 24 when retractable access portion 26 is in the retracted second position. By way of example and not by limitation, depicted in FIG. 4, each contact wire 58 also has a second end 84 positioned over second retention lip 64. Housing 24 also comprises a plurality of spaced apart transition wires 86. Each transition wire 86 includes a first portion 88 openly exposed on bottom wall 72 adjacent to front end 74 of housing 24; a second end portion 90 projecting from a back end 77 of housing 24; and a middle portion 92. Middle portion 92 can be enclosed within housing 24 as depicted in FIG. 4 or, in an alternative embodiment, middle portion 92 can simply be lowered relative to first portion 88 as depicted in FIG. 3. Second end portion 90 is electrically coupled to desired hardware such as circuit board 16.

With retractable access portion 26 in the first position, second end 84 of contact wire 58 is in contact with front end portion 88 of transition wire 86, thereby effecting electrical communication between retractable access portion 26 and housing 24. As retractable access portion 26 is moved into the retracted second position, as depicted in FIG. 6, second end 84 of contact wire 58 is slid over middle portion 92 of transition wire 86, thereby severing electrical communication between contact wire 58 and transition wire 86.

Figure 7:
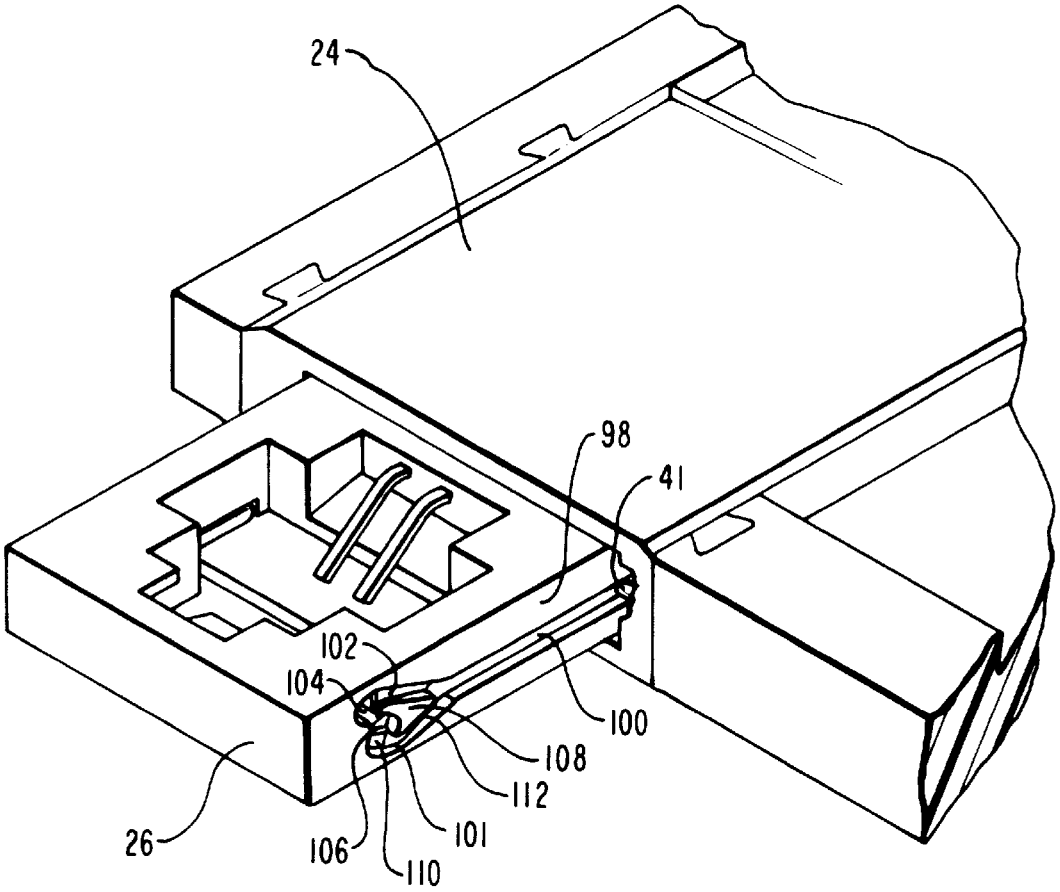
FIG. 7 is perspective view of the physical/electrical media jack shown in FIG. 5.

The present invention also includes means for selectively retaining retractable access portion 26 within housing 24. By way of example and not by limitation, depicted in FIG. 7 a channel 100 is recessed within a side 98 of retractable access portion 26. A ratcheted groove 101 is formed at the end of channel 100. Disposed within channel 100 is actuating shaft 41. As retractable access portion 26 is advanced into internal, chamber 38, actuating shaft 41 travels along channel 100 to ratcheted groove 101. Within ratcheted groove 101, actuating shaft 41 travels up a first ramp 102 and then drops into a first step 104. As retractable access portion 24 is released, actuating shaft 41 drops to a second step 106 and is biased against a brace 108.

The contact between actuating shaft 41 and brace 108 prevents retractable access portion 26, which is continually urged by springs 48, from automatically advancing out of internal chamber 38. To extend retractable access portion 26 from housing 24, retractable access portion 26 is pushed slightly into housing 24 causing actuating shaft 41 to drop onto a third step 110. As retractable access portion 26 is released, actuating shaft 41 slides over a descending ramp 112 and back into channel 100, thereby allowing retractable access portion 26 to freely slide outward until retention lips 64 and 66 are biased against blocking ridges 78 and 80 as previously discussed. The above process can be repeated to selectively move retractable access portion 26 between the projected first position and retracted second position. Alternative embodiments of the means for selectively retaining are disclosed in the '410 patent and '210 patent which were previously incorporated herein by specific reference.

Figure 8:
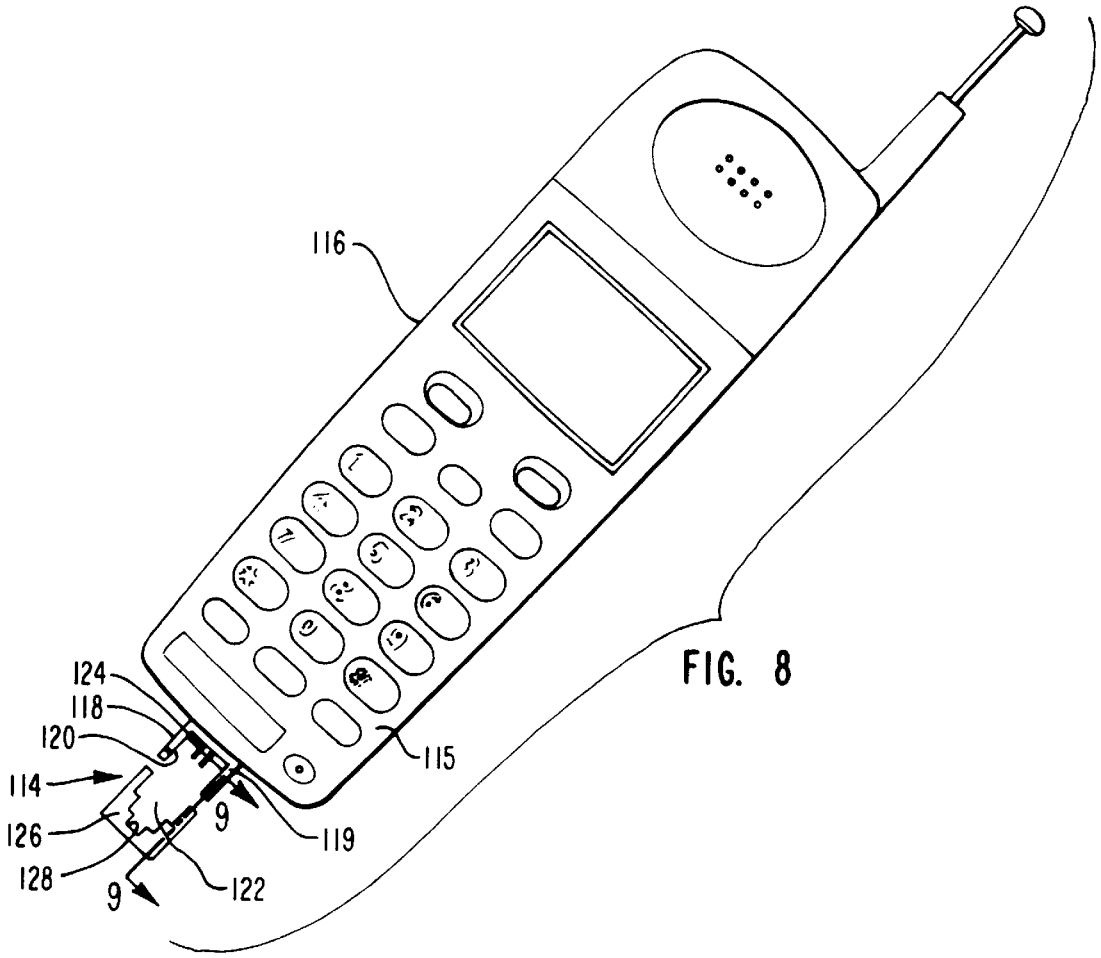
FIG. 8 is a front view of a telephone having an alternative embodiment of a physical/electrical media jack mounted thereon.
Figure 9:
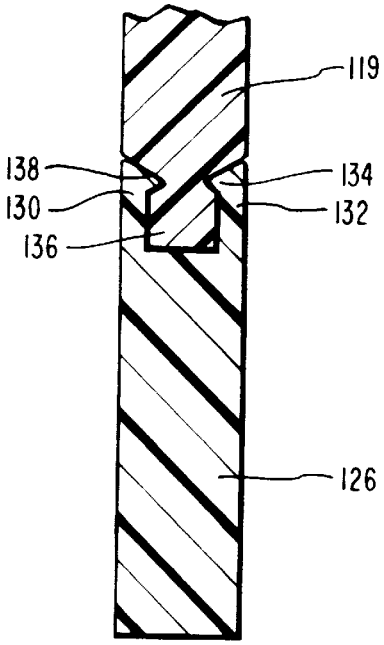
FIG. 9 is a cross-sectional side view of the physical/electrical media jack shown in FIG. 8 taken along section lines 9—9.

Although jack 14 is depicted in FIGS. 1 and 2 and being attached to a PC Card, in alternative embodiments, jack 14 can be directly attached to an electrical apparatus such as a computer, telephone, or modem, without being attached to a PC Card. In such embodiments, housing 24 can be directly secured to the casing of the electrical apparatus. Depicted in FIG. 8 is an alternative embodiment of an RJ type jack 114. Jack 114 is shown as being directly connected to a casing 115 of mobile telephone 116. In alternative embodiments, jack 114 can likewise be attached to a PC Card as previously discussed with regard to jack 14.

Jack 114 is shown as comprising a retractable access portion 118 having an aperture 122 extending therethrough.

Aperture 122 is configured to receive a physical/electrical media plug in the same way that aperture 54 of retractable access portion 26 was configured to receive plug 6. Retractable access portion 118 can be configured to be received within housing 24 in the same way that retractable access portion 26 is received therein. As will be discussed later, however, it is not necessary that retractable access portion 118 be removable from housing 24. In alternative embodiments, retractable access portion 118 can be rigidly attached to mobile telephone 116 or be removably attached to or retractable into telephone 116 using the technology disclosed in the '410 patent and '210 patent which were previously incorporated herein by specific reference.

Retractable access portion 118 includes a mounting portion 119 and an interior surface 120 that bounds a portion of aperture 122. Attached to mounting portion 119 are a pair of contact wires 124. Retractable access portion 118 further includes a breakaway portion 126 having an interior surface 128 that also bounds a portion of aperture 122.

The present invention also includes means for releasably attaching breakaway portion 126 to mounting portion 119. By way of example and not by limitation, breakaway portion 126 includes on each side of aperture 122 a pair of spaced apart clamping fingers 130 and 132. Each of clamping fingers 130 and 132 has an inwardly facing barb 134. In complement, mounting portion 119 includes on each side of aperture 122 a tapered stem 136. Notches 138 are formed on each side of stem 136. By pushing clamping fingers 130 and 132 against stem 136, stem 136 is received therebetween such that barbs 134 are biased within notches 138. As a result, breakaway portion 126 is secured to mounting portion 119. When sufficient tension force is applied between breakaway portion 126 and mounting portion 119, such as when a cable secured by a plug to aperture 122 is pulled or tripped over, breakaway portion 126 can separate from mounting portion 119 without mechanical failure.

There are a variety of alternative embodiments which could be used equally well for removably attaching breakaway portion 126 to mounting portion 119. For example, clamping fingers 130 and stem 136 could be interchanged between breakaway portion 126 is and mounting portion 119. Likewise, the configuration of clamping fingers 130 and stem 136 could be complementarily varied or rotated at different angles.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A physical/electrical media jack for electrically coupling with a physical/electrical media plug, the physical/electrical media jack comprising:

(a) a housing having an internal chamber communicating with the exterior through an opening;

(b) a retractable access portion slidably positioned within the internal chamber of the housing, the retractable access portion being selectively moved between a first position wherein the retractable access portion projects from the housing through the opening thereof and a second position wherein the retractable access portion is substantially enclosed within the internal chamber of the housing;

(c) coupling means for electronically coupling the media plug with the retractable access portion;

(d) detachment means for selectively detaching at least a portion of the retractable access portion from the housing, wherein the detachment means comprises the retractable access portion having a first retention lip projecting therefrom and the housing having a first blocking ridge projecting into the internal chamber at the opening, the first retention lip being biased against first blocking ridge when the retractable access portion is in the first position so as to hold the retractable access portion within the housing but permitting the first retention lip to pass over the first blocking ridge when a predetermined outward force is applied to the retractable access portion.

2. A physical/electrical media jack as recited in claim 1, wherein the coupling means comprises:

(a) an aperture formed in the retractable access portion, the aperture being configured to receive the media plug; and (b) a contact wire mounted to the retractable access portion and projecting into the aperture.

3. A physical/electrical media jack as recited in claim 2, further comprising means for preventing passage of the media plug completely through the aperture.

4. A physical/electrical media jack as recited in claim 3, wherein the means for preventing passage of the media plug completely through the aperture comprises a wire support stirrup attached to the retractable access portion so as to span across the aperture.

5. A physical/electrical media jack as recited in claim 2, further comprising means for mechanically securing the media plug within the aperture.

6. A physical/electrical media jack as recited in claim 1, further comprising contact means for facilitating electrical connection between the retractable access portion and the housing when the retractable access portion is in the first position and for preventing electrical connection between retractable access portion and the housing when the retractable access portion is in the second position.

7. A physical/electrical media jack as recited in claim 6, wherein the contact means comprises:

(a) a transition wire having a first end disposed within the interior chamber adjacent to the opening thereof, an opposing second end projecting outside the housing, and a middle portion embedded within the housing; and (b) a contact wire attached to the retractable access portion, the contact wire having an end positioned to bias against the transition wire when the retractable access portion is in the first position.

8. A physical/electrical media jack as recited in claim 1, further comprising means for biasing retractable access portion in a direction external to the housing.

9. A physical/electrical media jack as recited in claim 8, wherein the means for biasing comprises a spring disposed within the internal chamber and biased between the retractable access portion and the housing.

10. A physical/electrical media jack as recited in claim 1, further comprising means for selectively retaining the retractable access portion within the housing.

11. A physical/electrical media jack for electrically coupling with a physical/electrical media plug, the physical/electrical media jack comprising:

(a) a housing having an internal chamber communicating with the exterior through an opening;

(b) a retractable access portion slidably positioned within the internal chamber of the housing, the retractable access portion being selectively moved between a first position wherein the retractable access portion projects from the housing through the opening thereof and a second position wherein the retractable access portion is substantially enclosed within the internal chamber of the housing;

(c) coupling means for electrically coupling the media plug with the retractable access portion when the retractable access portion is in the first position; and (d) contact means for facilitating electrical connection between the retractable access portion and the housing when the retractable access portion is in the first position and for preventing electrical connection between retractable access portion and the housing when the retractable access portion is in the second position.

12. A physical/electrical media jack as recited in claim 11, wherein the contact means comprises:

(a) a transition wire having a first end disposed within the interior chamber adjacent to the opening thereof, an opposing second end projecting outside the housing, and a middle portion embedded within the housing; and (b) a contact wire attached to the retractable access portion, the contact wire having an end positioned to bias against the transition wire when the retractable access portion is in the first position.

13. A physical/electrical media jack as recited in claim 11, wherein the coupling means comprises:

(a) an aperture formed in the retractable access portion, the aperture being configured to receive the media plug; and (b) a contact wire mounted to the retractable access portion and projecting into the aperture.

14. A physical/electrical media jack as recited in claim 13, further comprising means for preventing passage of the media plug completely through the aperture.

15. A physical/electrical media jack as recited in claim 13, further comprising means for mechanically securing the media plug within the aperture.

16. A physical/electrical media jack as recited in claim 11, further comprising detachment means for selectively detaching at least a portion of the retractable access portion from the housing.

17. A physical/electrical media jack as recited in claim 16, wherein the detachment means comprises the retractable access portion having a first retention lip projecting therefrom and the housing having a first blocking ridge projecting into the internal chamber at the opening, the first retention lip being biased against first blocking ridge when the retractable access portion is in the first position so as to hold the retractable access portion within the housing but permitting the first retention lip to pass over the first blocking ridge when a predetermined outward force is applied to the retractable access portion.

18. A physical/electrical media jack as recited in claim 16, wherein the detachment means comprises:

(a) the retractable access portion having a pair of retention lips projecting from opposing sides thereof; and (b) the housing having a pair blocking ridge projecting into the internal chamber at opposing sides of the opening, the retention lips being biased against corresponding blocking ridges when the retractable access portion is in the second position so as to hold the retractable access portion within the housing but permitting the retention lips to pass over the blocking ridges when a predetermined outward force is applied to the retractable access portion.

19. A physical/electrical media jack as recited in claim 11, further comprising means for biasing retractable access portion in a direction external to the housing.

20. A physical/electrical media jack as recited in claim 11, further comprising means for selectively retaining the retractable access portion within the housing.

21. A physical/electrical media jack for electrically coupling with a physical/electrical media plug, the physical/electrical media jack comprising:

(a) a retractable access portion having an aperture formed thereon and a first retention lip projecting from an end thereof; and (b) a housing having an interior surface at least partially bounding a chamber, the chamber communicating with the exterior through an opening, a first blocking ridge projecting from the interior surface into the chamber at the opening, the housing being configured to receive the end of the retractable access portion so that the first retention lip is biased against the inside of the first blocking ridge, the housing also being configured to allow expansion of the opening so as to enable removal of the retractable access portion from within the housing when an predetermined outward force is applied to the retractable access portion.

22. A physical/electrical media jack as recited in claim 21, wherein the retractable access portion is slidably positioned within the internal chamber of the housing, the retractable access portion being selectively moved between a first position wherein the retractable access portion projects from the housing through the opening thereof and a second position wherein the retractable access portion is substantially enclosed within the internal chamber of the housing.

23. A physical/electrical media jack as recited in claim 22, further comprising contact means for facilitating electrical connection between the retractable access portion and the housing when the retractable access portion is in the first position and for preventing electrical connection between retractable access portion and the housing when the retractable access portion is in the second position.

24. A physical/electrical media jack for facilitating physical and electrical connection of a physical/electrical media plug with a host device, the physical/electrical media jack comprising:

a housing with an opening to an internal chamber; and a retractable access portion slidably positioned within the internal chamber of the housing, the retractable access portion being selectively movable between a first position and a second position, said first position wherein a substantial portion of the retractable access portion projects from the housing through the opening and said retractable access portion is in electrical communication with the housing, said second position wherein the retractable access portion is substantially enclosed within the internal chamber of the housing and said retractable access portion is not in electrical communication with said housing.

25. The physical/electrical media jack of claim 24, further comprising one or more contact wires, said contact wires allowing electrical communication between said retractable access portion and said housing when said retractable access housing is in said first position.

26. The physical/electrical media jack of claim 25, wherein said contact wires are electrically disconnected between said retractable access portion and said housing when said retractable access portion is in said second position.

27. A physical/electrical media jack for electrically coupling with a physical/electrical media plug, the physical/electrical media jack comprising:

a housing having an internal chamber communicating with the exterior through an opening;

a retractable access portion including an aperture sized and configured to receive the media plug, the retractable access portion being slidably positioned within the internal chamber of the housing, the retractable access portion being selectively movable between a first position wherein the retractable access portion projects from the housing through the opening thereof, and a second position wherein the retractable access portion is substantially enclosed within the internal chamber of the housing; and a plurality of contact wires mounted to the retractable access portion, each of the wires being in electrical communication with a corresponding electrical contact in the housing when the retractable access portion is in the first position, and each of the contact wires being electrically disconnected from the corresponding electrical contact in the housing when the retractable access portion is in the second position.

* * * * *